US005261625A

United States Patent [19]

Lanoue

[11] Patent Number: 5,261,625

[45] Date of Patent: Nov. 16, 1993

[54] DEVICE FOR DISPENSING WIRE, CABLE OR THE LIKE

[75] Inventor: Michel Lanoue, Ste-Foy, Canada

[73] Assignee: IPL Inc., St-Damien, Canada

[21] Appl. No.: 891,288

[22] Filed: May 29, 1992

[51] Int. Cl.[5] ..... B65H 49/18; B65H 59/02

[52] U.S. Cl. ..... 242/129.8; 242/129.62; 242/137.1; 242/156

[58] Field of Search ..... 242/129.8, 129.5, 129.51, 242/129.53, 129.6, 129.62, 129.7, 129.71, 129.72, 132, 137, 137.1, 138, 146, 156, 156.2, 54 R, 128, 129, 170, 171, 78

[56] References Cited

U.S. PATENT DOCUMENTS

| | | | |
|---|---|---|---|
| 209,144 | 10/1878 | Storle | 242/156 X |
| 248,261 | 10/1881 | Hubbard | 242/129.53 |
| 1,354,598 | 10/1920 | Crumbaugh | 242/137 |
| 1,474,580 | 11/1923 | Clark et al. | 242/137.1 |
| 1,908,073 | 5/1933 | Spoor et al. | 242/129 |
| 3,027,003 | 3/1962 | Cole et al. | 242/137.1 |
| 3,069,107 | 12/1962 | Hirt | 242/156 X |
| 3,150,769 | 9/1964 | Cohn | 242/137 |
| 3,680,810 | 8/1972 | Jarmalow | 242/137.1 X |
| 3,796,392 | 3/1974 | Starace | 242/156 |
| 3,982,712 | 9/1976 | Bassett | 242/137.1 X |
| 4,010,914 | 3/1977 | Kowalski | 242/129.62 |
| 4,077,586 | 3/1978 | Thomas et al. | 242/137.1 X |
| 4,108,397 | 8/1978 | Hauck | 242/137.1 |
| 4,124,176 | 11/1978 | Carlson et al. | 242/156 |
| 4,126,281 | 11/1978 | Young | 242/137.1 X |
| 4,685,633 | 8/1987 | Pellini | 242/129.6 |

FOREIGN PATENT DOCUMENTS

| | | |
|---|---|---|
| 970749 | 7/1975 | Canada . |
| 1071605 | 2/1980 | Canada . |

*Primary Examiner*—Stanley N. Gilreath

*Attorney, Agent, or Firm*—Merchant & Gould; Smith, Edell, Welter & Schmidt

[57] ABSTRACT

The disclosure describes herein a box within which is mounted a reel having a supply of wire, cable or the like to be dispensed. An opening is provided in one of the walls of the box to allow the egress of one end of the strand. A cover securely contains the reel within the box. Also mounted within the box is a brake device which has a portion slidingly contacted by the strand prior to egressing from the box. An external pull on the strand frees interengageable elements on the brake device and on one of the side plates of the reel from blocking rotation of the reel in one direction. As soon as a pull is no longer exerted on the strand, a resilient element on the brake device urges the elements to interengage to thereby stop rotation of the reel.

19 Claims, 7 Drawing Sheets

DEVICE FOR DISPENSING WIRE, CABLE OR THE LIKE

FIELD OF THE INVENTION

The present invention pertains to a device for dispensing wire, cable or the like and, more particularly, to a device which further stops rotation of a reel carrying a supply of wire, cable or the like as soon as dispensing is no longer needed.

BACKGROUND OF THE INVENTION

At present, installers of cables, wires or the like for utilities companies draw from a reel a quantity of wire or cable to be installed. One example of a package of wire or cable and of a method of producing such package is that known under the trademark REELEX and may be found described in Canadian patents no. 970,749 issued Jul. 8, 1975 and U.S. Pat. No. 1,071,605, both issued Feb. 12, 1980 in the name of Windings, Inc. One problem with such a package is the manner in which the wire is coiled, i.e. in a 8-shape. When a pull is exerted on the wire to deliver it from the package, the wire tends to retain a certain amount of stress due to its packaged configuration, which stress causes a spring effect in the wire often resulting in entanglement of strands. Also, this package is delivered in a non-reusable cardboard box (usually waxed) causing environment problems, once emptied and discarded. Another problem is that some cable is always lost since unused pulled-out cable cannot be rewound into the package or in the box.

In other wire dispensing devices, such as ordinary reels, again, it has been found that there are important losses of unused cables and wires whenever a reel is not equipped with a system to stop effectively the rotation of the reel; this results in an oversupply of wire, or cable, as it is removed from the reel. Such oversupply is lost because, for the operator, it is difficult or too time-consuming to rewind it at the end of each installing operation. For him, it is much simpler to cut and dispose of the excess wire than to rewind it. They are other problems associated with such oversupply, such as, again, entanglement of strands on the ground or floor as well as the possibility of having the strands laying in areas where they should not be present or in contact with parts or things with which they ought not to be.

OBJECTS AND FIELD OF THE INVENTION

It is an object of the present invention to overcome the above problems associated with the dispensing of wire, cable or the like from reels or packages of flexible material for twistless lay-out.

This is achieved by mounting, within a box, a reel having a supply of wire, cable or the like, and a brake mechanism which will allow the rotation of the reel in one direction, i.e. of dispensing, but which will stop rotation of the reel as soon as the dispensing or pulling force is no longer felt on the strand.

The present invention therefore relates to a device for dispensing wire, cable or the like which comprises:

a) a box defining a parallelepiped body having a bottom, sidewalls and a removable cover; the box displaying an opening for the egress therefrom of a strand of wire, cable or the like;

b) a reel rotatably mounted in the box; the reel consisting of a hub and opposite side plates confining therebetween a wound supply of wire, cable, or the like to be dispensed;

c) a brake device securely mounted in the box; the brake device having a pivotable portion adapted to be slidingly contacted by the strand prior to egressing from the box;

d) inter-engageable means on the brake device and on one of the side plates cooperating to stop rotation of the reel; and e) resilient means on the brake device urging the cooperating means in inter-engagement; the pivotable portion of the brake device being pivoted by a pull on the strand outside the box thereby freeing the cooperating means from engagement with one another and allowing the reel to rotate in a dispensing direction; the resilient means returning the cooperating means in engagement upon release of the pull to thereby block rotation of the reel.

In one preferred form of the invention, the cooperating means on the one side plate consist of spaced abutting surfaces disposed at the periphery of the said one side plate to be contacted by the cooperating means on the brake device.

In another embodiment of the present invention, the reel consists of a hub having, at one end, a fixed plate and, on the other end, a plate which has a first inner portion threaded onto the hub and a second outer portion which is co-axially mounted onto the first portion. Whenever there is a sudden stop due to the engagement of the brake mechanism, there is a tendency of the supply of wire of cable to overrun slightly on the hub; by being freely mounted on the inner annular portion, the outer portion follows this overrun of the wire supply thereby avoiding the threaded engagement of the inner portion of the plate to further tightly engage the threaded portion of the hub. Otherwise, it becomes difficult to remove the plate from hub to install a new supply of wire or cable.

In a further embodiment of the invention, the cover has downwardly extending legs which cooperate to maintain the reel within the box while allowing it to rotate and to be used in all positions possible.

Other objects and further scope of applicability of the present invention will become apparent from the detailed description given hereinafter. It should be understood however that this detailed description, while indicating preferred embodiments of the invention, is given by way of illustration only, since various changes and modifications within the spirit and scope of the invention will become apparent to those skilled in the art.

DESCRIPTION OF PREFERRED EMBODIMENTS

Figure 1:
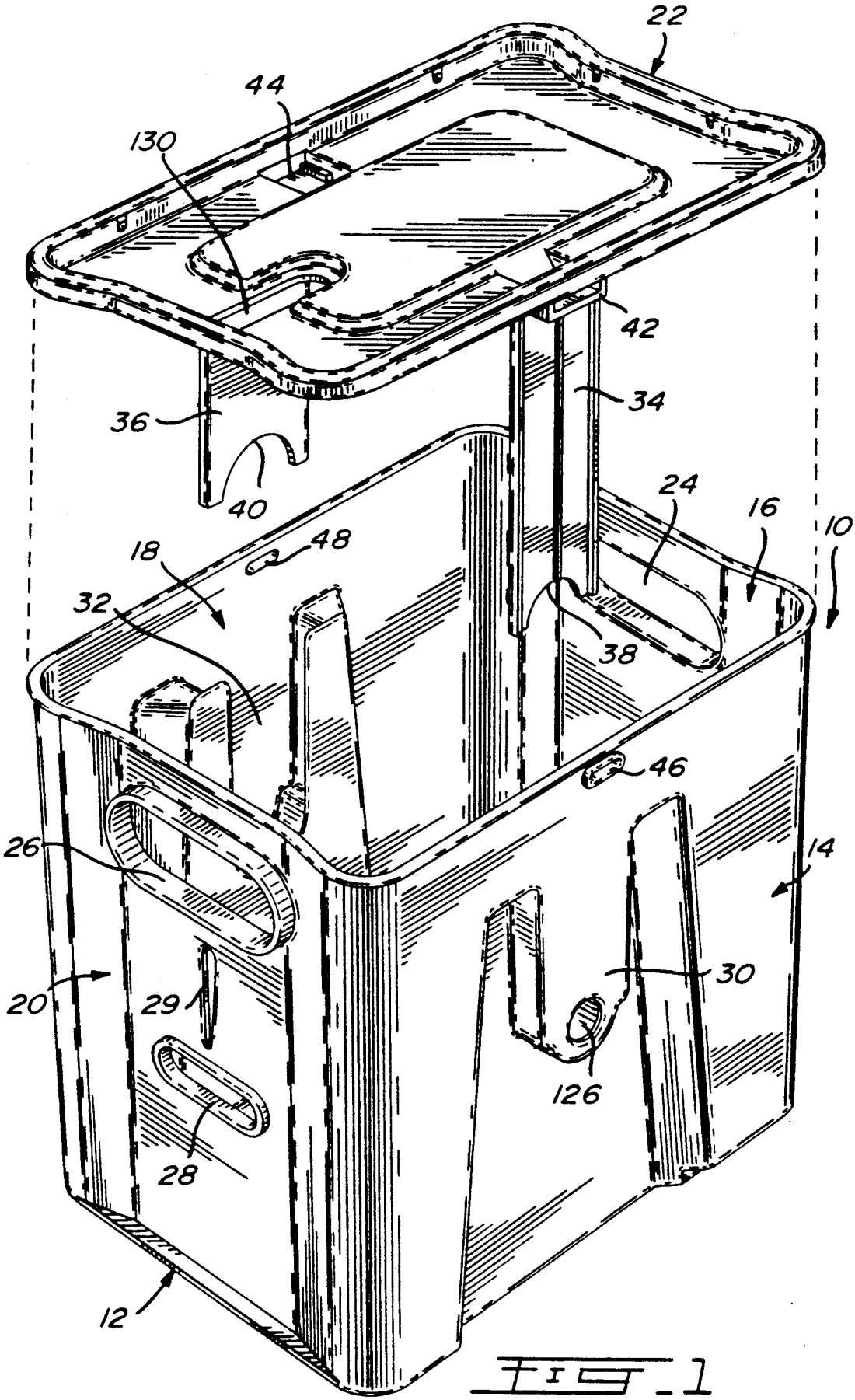
FIG. 1 is an exploded perspective view of the box and cover without the reel being mounted therein.

Referring to FIG. 1, there is shown a box, generally denoted 10, defining a parallelepiped body having a bottom 12, sidewalls 14, 16, 18 and 20 and a removable cover 22. Sidewalls 16 and 20 respectively display elongated openings 24 and 26 defining handles. Further elongated opening 28 and pointed slot 29 are provided on sidewall 20, the functions of which will be described further.

Walls 14 and 18 respectively include U-shaped outwardly projecting enlarged areas 30 and 32 in which are slid a pair of downwardly extending legs 34 and 36, respectively, integral with the undersurface of the cover 22. Each leg 34, 36 has a concave extremity 38, 40, the function of which will also be described hereinbelow. The cover 22 has a pair of opposite troughs 42 and 44, each having a side opening adapted to come into registry with corresponding openings 46 and 48 on the sidewalls 14 and 18 of the box. Once positioned on the box, the cover may be locked by appropriate means (not shown), such as spring loaded clips, fitted in these openings in registry.

Figure 2:
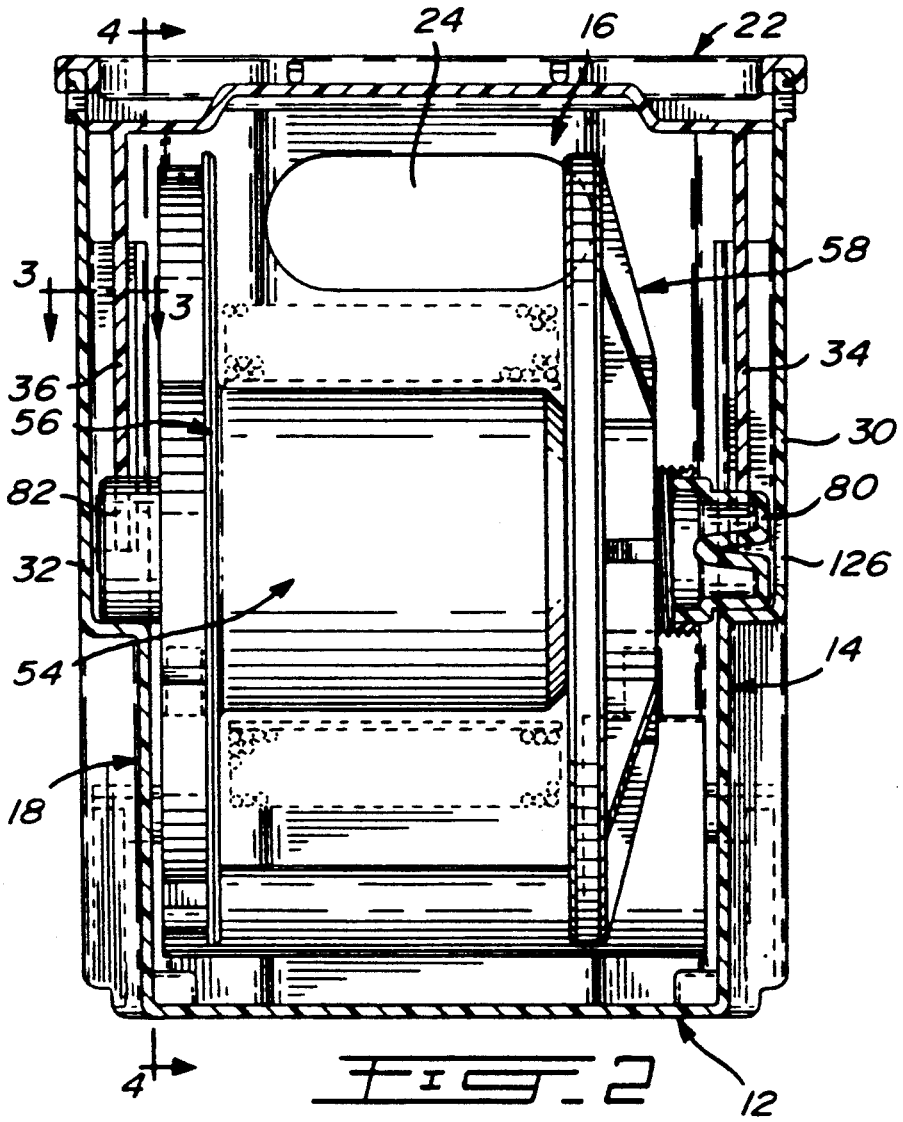
FIG. 2 is an elevation cross sectional view of the box with the reel mounted therein.
Figure 4:
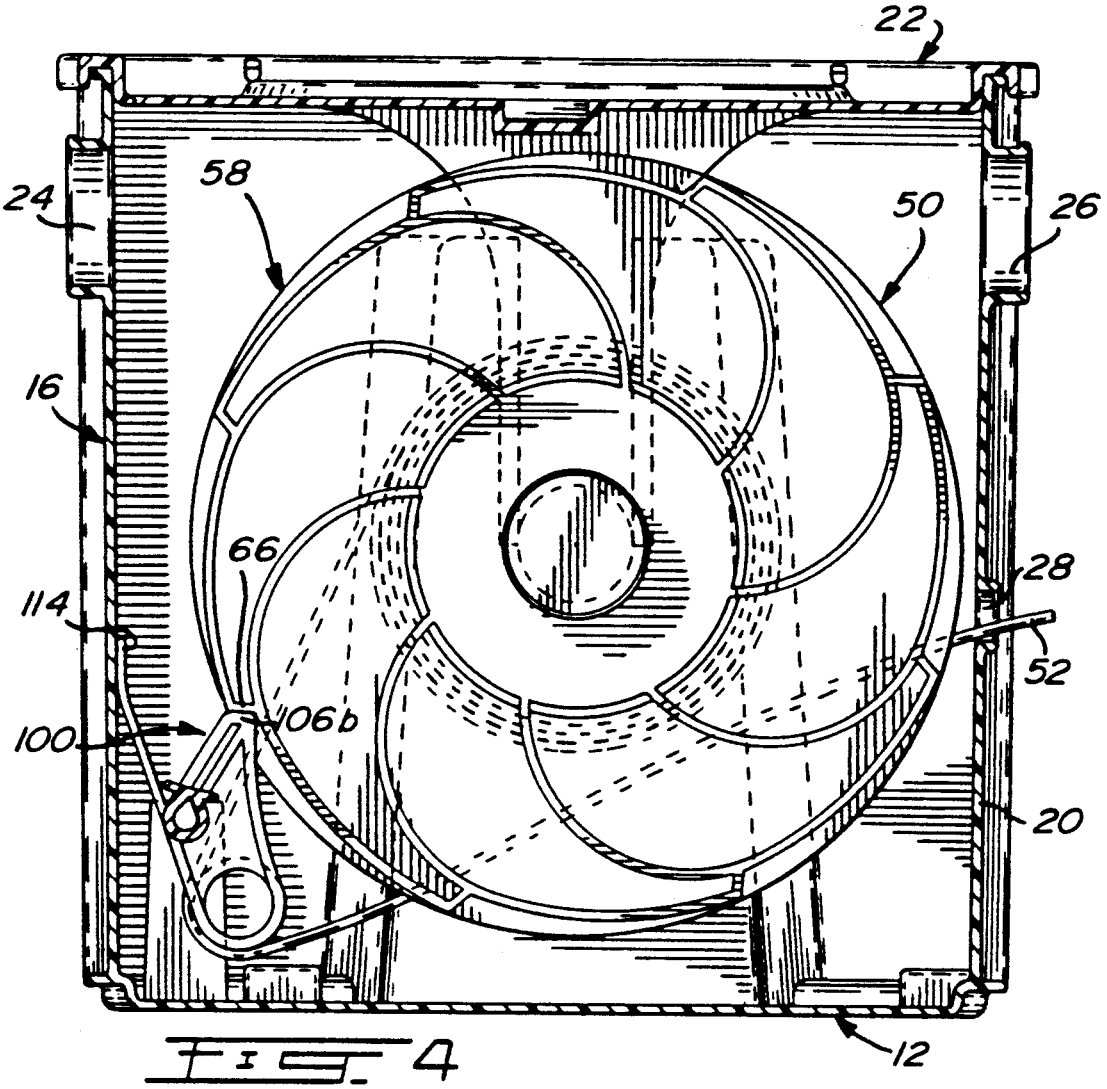
FIG. 4 is an elevation cross sectional view of the box, brake device and reel taken along lines 4—4 of FIG. 2.

Referring to FIGS. 2 and 4, there is shown a reel, generally denoted 50, on which is wound a supply of wire, cable or the like. A strand may be seen as 52 egressing from opening 28 on the sidewall 20 of the box. The reel 50 consists of a hub 54 to which is integrally formed a side plate 56 at one side thereof. At the other end of the hub is threadedly mounted a second side plate 58.

Figure 6:
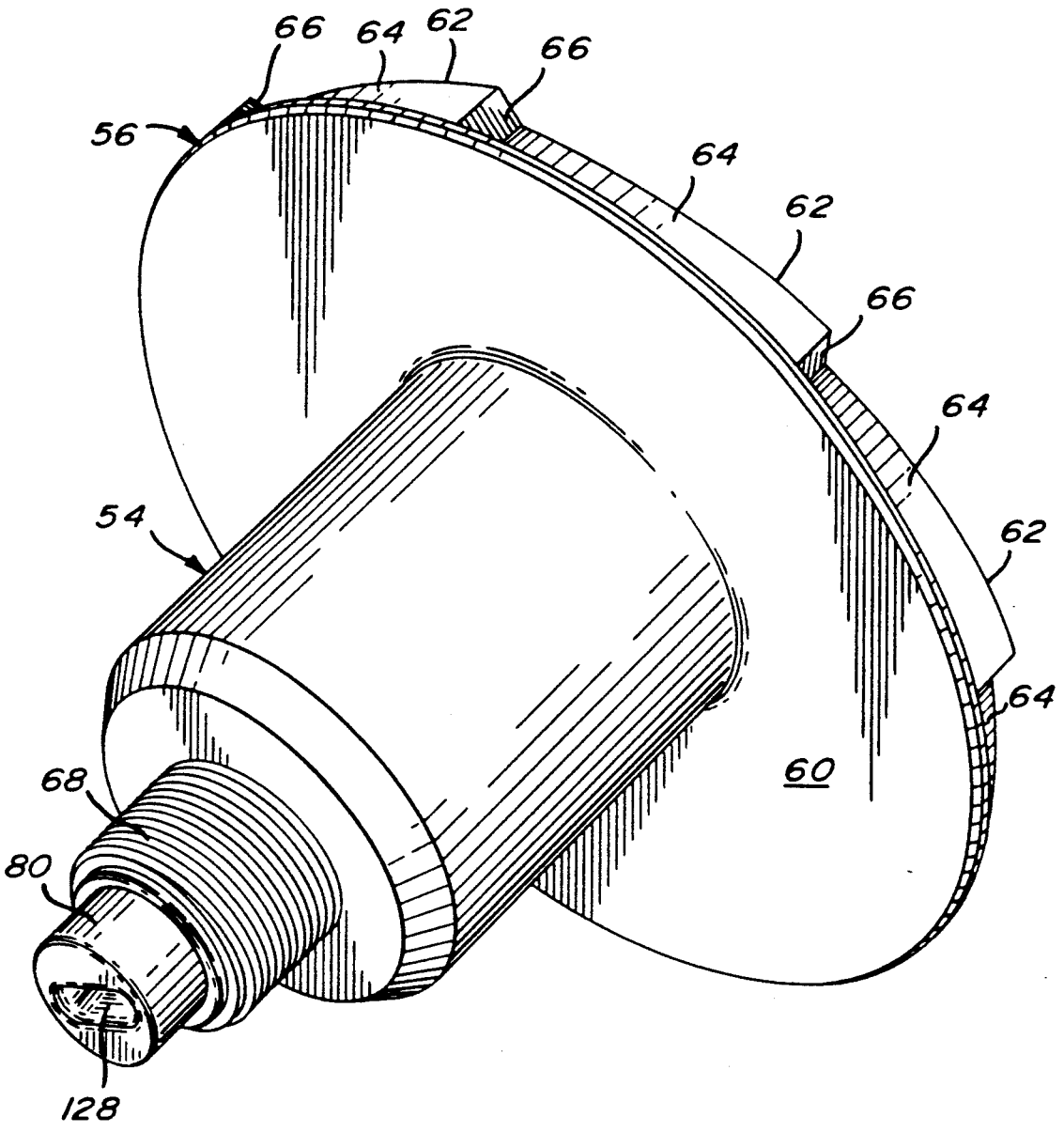
FIG. 6 is a perspective view of the hub with one integral side plate of the reel.

Referring to FIG. 6, the side plate 56 includes an annular wall 60, the rear face of which displays a series of circumferential elements 62, each constituted by a arc-shaped face 64 extending between faces 66 which are tangent thereto. The opposite end of the hub 54 has a threaded portion 68 on which is threadedly mounted the side plate 58.

Figure 7:
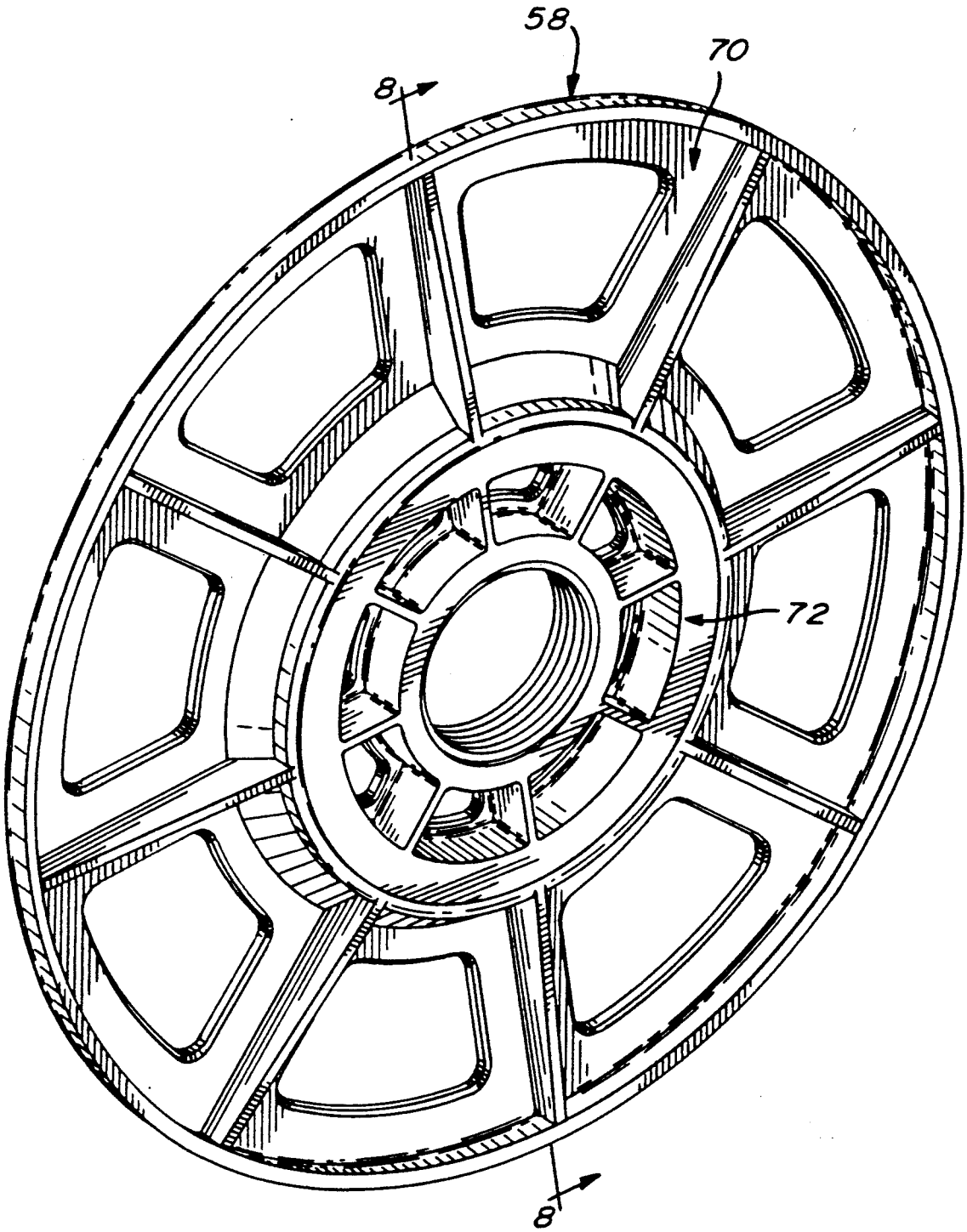
FIG. 7 is a perspective view of the other side plate of the reel.
Figure 8:
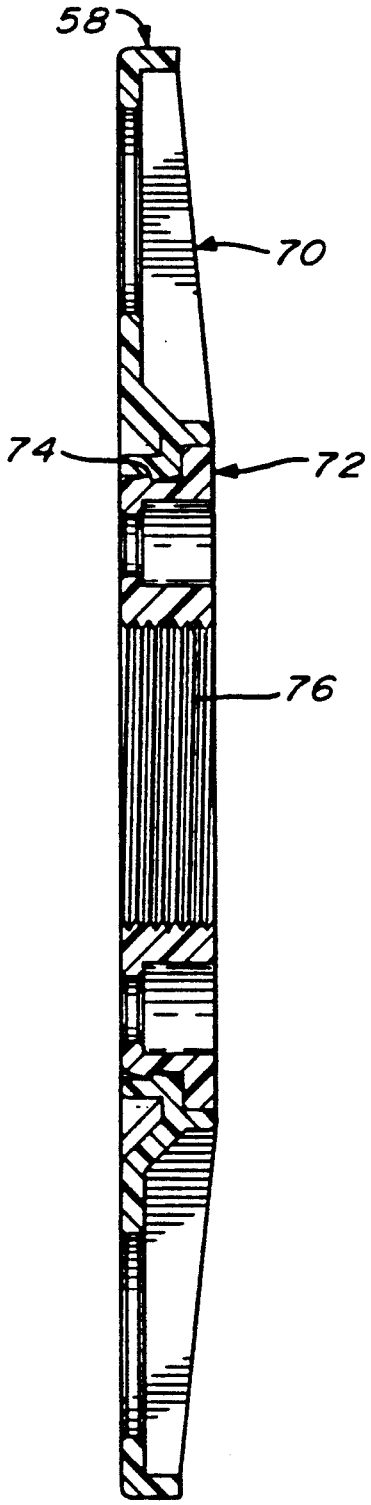
FIG. 8 is a cross-sectional view of the side plate taken along lines 8—8 of FIG. 7.

Referring to FIGS. 7 and 8, the opposite side plate 58 comprises an outer annular portion 70 circumferentially and concentrically mounted about an inner annular portion 72. The engagement between the two portions is accomplished through a tongue and groove arrangement 74, thereby allowing free rotation of the outer portion 70 relative to the inner portion 72, the latter having a threaded core 76 adapted to be engaged with threaded portion 68 of the hub.

Figure 3:
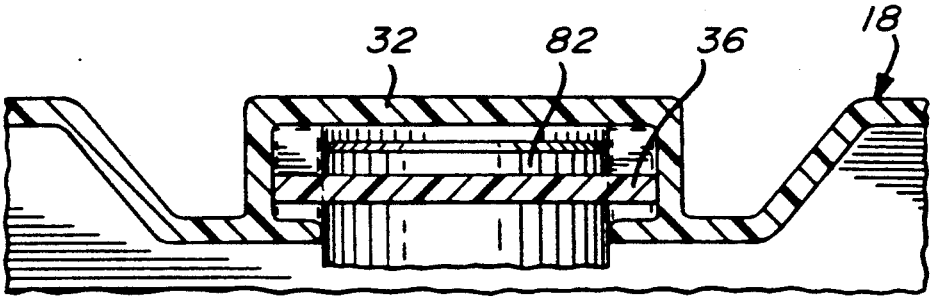
FIG. 3 is an enlarged cross-sectional view taken along lines 3—3 of FIG. 2.

As can been seen in FIGS. 2 and 3, the opposite ends 80 and 82 of the hub are seated within the enlarged portions 30 and 32 of the sidewalls 14 and 18 of the box. These opposite ends 80 and 82 are securely maintained within the box as they are confined between their respective seats in walls 14 and 18 and the concave extremities 38 and 40 of the legs 34 and 36 of the cover 22.

Figure 5:
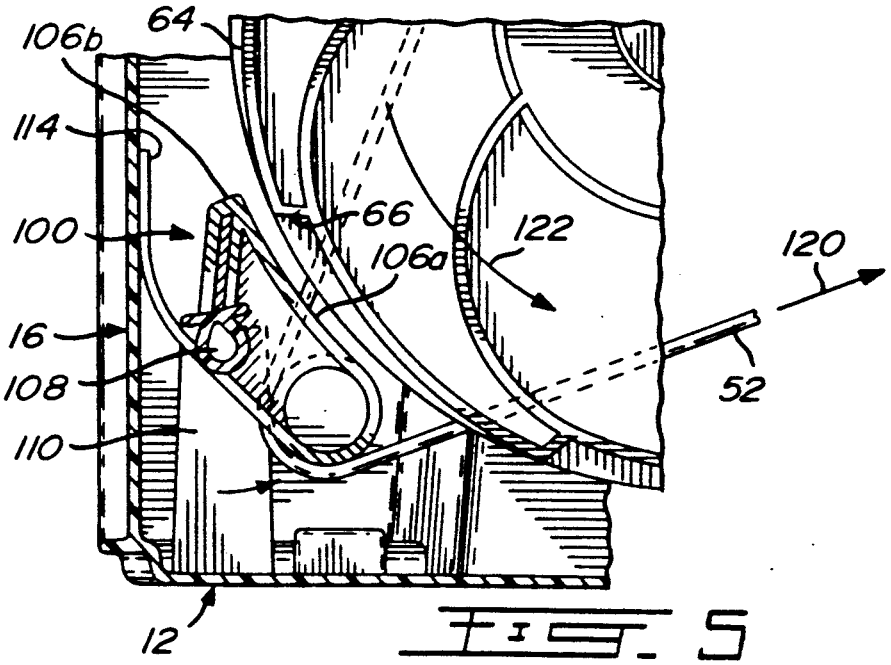
FIG. 5 is an enlarged cross-sectional view of the lower left corner area of FIG. 4.
Figure 9:
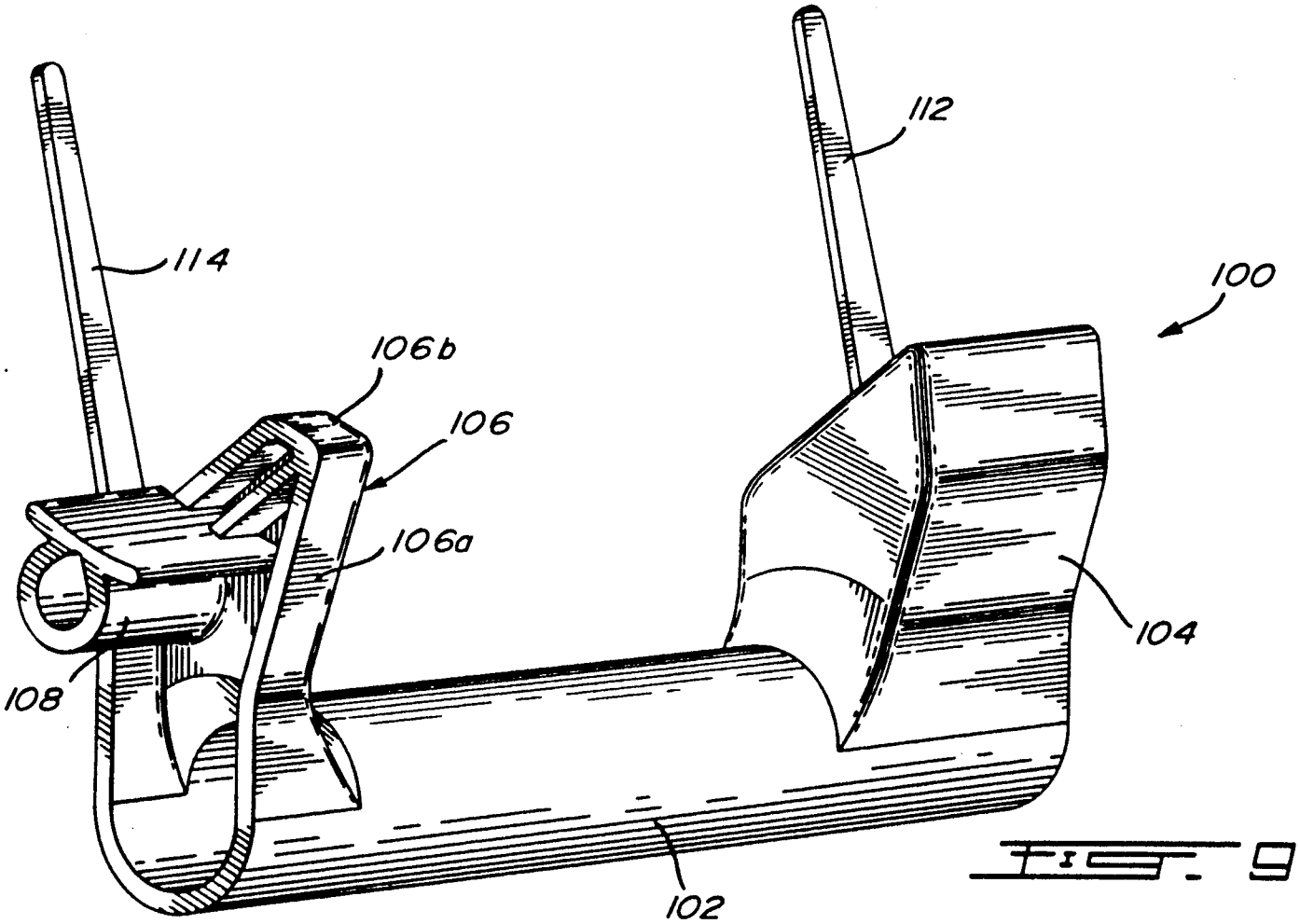
FIG. 9 is a perspective view of the brake device.

Referring to FIGS. 4, 5 and 9, also mounted within the box is a brake device, generally denoted 100, which has a cylindrical portion 102 and a pair of projecting members 104 and 106 at opposite ends thereof. Each member 104, 106 has a side extension (only one being shown as 108) acting as pivot for the brake device and adapted to rest on appropriate supports 110 mounted to the bottom 12 of the box as well as to each opposite sidewall 14, 18. Extending rearwardly of each member 104, 106 is a pair of elongate resilient elements 112 and 114 which, once installed in the box, contactingly press against the sidewall 16 as illustrated in FIGS. 4 and 5.

The cylindrical surface 102 acts as a sliding surface for the passage of the strand of wire or cable 52 thereon as it is unwound from the reel prior to passing through the opening 28. The projecting member 106 has a first surface 106*a* adapted to slide along the surface 64 on the side plate of the reel and a second abutting surface 106*b* adapted to contact the tangent surface 66 to stop the reel from rotating. As illustrated in FIGS. 4 and 5, the brake device 100 has its abutting surface 106*b* contacting surface 66; hence, rotation of the reel 58 in a counterclockwise direction as indicated by arrow 122 is prevented. A pull exerted on the strand 52 in the direction indicated by arrow 120, as it slides on the cylindrical surface 102, causes the brake device to pivot at the side extensions 108 thereby distancing surface 106*b* from surface 66 of the reel. This pivotal action also causes a further compression of the resilient elements 112 and 114 against the wall 16. As soon as the external pull is released, the resiliency of the compressed elements 112 and 114 causes a pivotal movement of the brake device about pivots 108, thus causing surface 106*a* of the brake device to slide along the next sliding surface 64 of the reel until the abutting surface 106*b* contacts the next stop surface 66. Hence, the construction of the brake device is such as to enable an unwinding rotation of the reel in the direction indicated by arrow 122. However, immediate stoppage of rotation is achieved as soon as no pull is exerted on the strand.

The sudden stoppage of the reel causes the supply of wire on the reel to slide on the hub in the rotational direction. Normally, this would result in a further tightening engagement of the threaded portion 76 of the side plate onto the threaded portions 68 of the hub. However, the particular construction of the side plate 58 with its freely rotatable portion 70 allows the latter to follow the incremental movement of the hub supply, thus avoiding further tightening between the engaged threaded portions.

The side extension 30 on wall 14 has an opening 126, thus giving access to a tool to be inserted and engage a slot 128 at the extremity 80 of the reel; this allows the user to rewind that portion of the strand outside the box which is not used without removing the cover. Once the free end of the strand is adjacent the box, it can be tightly squeezed into the slot 29 in the sidewall 20 of the box.

A slot 130 is provided on cover 22 to give an indication to the operator the amount of wire left on the reel; graduation marks could also be provided adjacent to the slot to indicate more accurate amount of the wire left.

Although the invention has been described above in relation with one specific form, it will be evident to the person skilled in the art that it may be modified and refined in various ways. It is therefore wished to have it understood that the present invention should not be limited in interpretation except by the terms of the following claims.

The embodiments of the invention in which an exclusive property or privilege is claimed are defined as follows:

1. A device for dispensing wire, cable, or the like, comprising:

a) a box defining a parallelepiped body having a bottom, side walls and a removable cover; said box displaying an opening for the egress therefrom of a strand of wire, cable or the like;

b) a reel rotatably mounted in said box; said reel consisting of a hub and opposite side plates confining therebetween a wound supply of wire, cable, or the like to be dispensed;

c) a brake device securely mounted in said box; said brake device having a pivotable portion adapted to be slidingly contacted by said strand prior to egressing from said box;

d) inter-engageable means on said brake device and on one of said side plates cooperating to stop rotation of said reel; and e) resilient means having a first portion secured to said brake device and a second portion contacting a side wall of said box, said second portion being resiliently compressed against said side wall to urge said cooperating means in inter-engagement; said pivotable portion of said brake device being pivoted by a pull on said strand outside said box thereby freeing said cooperating means from engagement with one another and allowing said reel to rotate in a dispensing direction; said resilient means returning said cooperating means in engagement upon release of said pull to thereby block rotation of said reel.

2. A device as defined in claim 1, wherein said cooperating means on said one side plate consist of a series of spaced abutting surfaces disposed peripherally on said one side plate to be contacted by the cooperating means on said brake device.

3. A device as defined in claim 2, wherein said one side plate further includes inwardly curved sliding surfaces extending between said abutting surfaces.

4. A device as defined in claim 1, wherein said hub and said one side plate define an integrally formed body.

5. A device as defined in claim 4, wherein said hub includes at one end opposite to said one side plate a threaded portion.

6. A device as defined in claim 5, wherein the other of said side plates is threadedly mounted onto said threaded portion of said hub.

7. A device as defined in claim 6, wherein said other side plate consists of two concentrically mounted portions including an inner annular portion threadedly engaged with said hub and an outer annular portion freely mounted to said inner portion.

8. A device as defined in claim 1, wherein two opposite side walls of said box each include support means to rotatably receive thereon opposite ends of said hub.

9. A device as defined in claim 8, wherein said cover has means downwardly extending in said box adjacent said opposite side walls to confine said reel in said box.

10. A device as defined in claim 9, wherein said downwardly extending means consist of a pair of legs each having a lower end configured to extend over a corresponding portion of said end of said hub.

11. A device as defined in claim 10, wherein said opposite side walls of said box have recessed areas to receive therein said pair of legs.

12. A device as defined in claim 11, wherein one of said recessed areas include a wall opening to provide access to one end of said hub; said one end of said hub having tool engaging means to receive a tool for manually rotating said reel from outside said box.

13. A device as defined in claim 1, wherein said resilient means consist of a pair of flexible elongated members having one end secured to said brake device and the opposite end adapted to contact a side wall of said box.

14. A device as defined in claim 13, wherein said pivotable portion of said brake device includes a cylindrical body defining a sliding surface to allow sliding passage of said strand thereon.

15. A device as defined in claim 14, wherein said cooperating means on said brake device consist of projecting means on said cylindrical body adapted to contact said cooperating means on said one side plate of said reel.

16. A device as defined in claim 1, wherein said cover includes means cooperating with means on opposite side walls for locking said cover to said box.

17. A device as defined in claim 1, wherein said cover includes an opening to provide visual indication of the wire, cable or the like remaining on said reel in said box.

18. A device as defined in claim 1, wherein a pair of opposite side walls of said box each include an opening defining a handle allowing said box to be carried.

19. A device as defined in claim 1, wherein one of said side walls includes the opening allowing egress of a strand of wire, cable or the like, wherein said one side wall further includes slot means to fix one free end of the strand of wire, cable or the like.

* * * * *

UNITED STATES PATENT AND TRADEMARK OFFICE

CERTIFICATE OF CORRECTION

PATENT NO. : 5,261,625

DATED : November 16, 1993

INVENTOR(S) : Michel Lanoue

It is certified that error appears in the above-identified patent and that said Letters Patent is hereby corrected as shown below:

On the title page: Item (75), line Inventors, after "Ste-Foy," insert --Quebec,--.

(73), line Assignee, after "St-Damien," insert --Quebec,--.

After (22) Filing Date: insert --(30) Foreign Application Priority Data 5-15-92 Canada 2,068,828.9--.

Signed and Sealed this

Twenty-fourth Day of May, 1994

*Attest:*

*Attesting Officer*

BRUCE LEHMAN

*Commissioner of Patents and Trademarks*